US008353730B1

(12) United States Patent
Wang et al.

(10) Patent No.: US 8,353,730 B1
(45) Date of Patent: Jan. 15, 2013

(54) PROBE CONNECTOR

(75) Inventors: Hung-Chi Wang, Taoyuan (TW); Jui-Pin Lin, Taoyuan (TW)

(73) Assignee: Proconn Technology Co., Ltd., Taoyuan (TW)

( * ) Notice: Subject to any disclaimer, the term of this patent is extended or adjusted under 35 U.S.C. 154(b) by 0 days.

(21) Appl. No.: 13/288,021

(22) Filed: Nov. 2, 2011

(51) Int. Cl.
*H01R 12/00* (2006.01)

(52) U.S. Cl. ..... 439/700; 439/515

(58) Field of Classification Search ..... 439/700, 439/515, 169, 824
See application file for complete search history.

(56) References Cited

U.S. PATENT DOCUMENTS 6,814,626 B2 * 11/2004 Wen-Yao ..... 439/700
7,134,878 B2 * 11/2006 Zheng et al. ..... 439/65

* cited by examiner

*Primary Examiner* — Gary F. Paumen
(74) *Attorney, Agent, or Firm* — Lin & Associates IP, Inc.

(57) ABSTRACT

A probe connector includes an insulating housing defining inserting passages each longitudinally penetrating therethrough with a blocking rib being protruded in a periphery inside thereof. A probe has a base board of which a front end has a contact head stretched forward out of the inserting passage, and a rear end has a resisting board extending downward from an end edge thereof and two blocking boards protruded downward from two side edges thereof for cooperating with the blocking rib to prevent the probe from sliding out of the inserting passage. A terminal has a base plate blocking a rear end of the inserting passage, and an elastic arm extending forward from a top of the base plate with a free end designed as a contact portion abutting against the base board. An elastic element is retractably located between the resisting board and the base plate.

5 Claims, 3 Drawing Sheets

PROBE CONNECTOR

BACKGROUND OF THE INVENTION

1. Field of the Invention

The present invention relates to a connector, and more particularly to a probe connector.

2. The Related Art

Probe connectors are mainly used in mobile phones for electrically connecting with cards or batteries received in the mobile phones. A conventional probe connector generally includes an insulating housing and a plurality of probe pin assemblies mounted in the insulating housing. The probe pin assembly includes a cylindraceous barrel having a bottom plate closing one end mouth thereof, a spring received in the barrel, a probe of which a bottom end is movably inserted in the barrel and designed with a receiving hole for receiving a top of the spring therein. A top end of the probe is stretched outside from the other open end mouth of the barrel for contacting an external device.

However, the probes of the probe connector need to be separately made by a turning process. As a result, it is hard to hold the probe in the process of electroplating the probe on account of the probe being small size that causes the probe easily to drop and results in a great loss of the probe. Furthermore, the receiving hole of the probe is often so small that it hard to clean the receiving hole and electroplate periphery inner sides of the receiving hole. As a result, the receiving hole of the probe is often amassed by grease therein or has a poor electroplate effect on the periphery inner sides thereof. It further results in low production efficiency and poor product yield of the probe connector.

SUMMARY OF THE INVENTION

An object of the present invention is to provide a probe connector which includes an insulating housing and a plurality of probe pin assemblies. The insulating housing defines a plurality of accommodating cavities each penetrating through a rear side of the insulating housing, and a plurality of receiving cavities each penetrating through a front side of the insulating housing and connected with a front of one accommodating cavity. A blocking rib is protruded at the junction of the accommodating cavity and the receiving cavity. A top wall of each accommodating cavity is provided with an inserting slot penetrating through the rear side of the insulating housing and further connected with the receiving cavity. The probe pin assembly includes a probe curved from a metal board and having a first base board, a second base board and an arched contact head connecting two ends of the first base board and the second base board to make the first base board and the second base board apart face each other in parallel. The other end of the first base board is perpendicularly bent downward to form a resisting board, and further has two opposite side edges thereof extended downward and then face-to-face protruded to form a pair of blocking boards. The end of the probe with the blocking boards is disposed in the accommodating cavity, and the contact head retractably stretches forward out of the receiving cavity, wherein the blocking boards can be blocked by the blocking rib to prevent the probe from sliding out of the receiving cavity. A terminal has a base plate blocking a rear end of the accommodating cavity. A bottom edge of the base plate is bent rearward to form a soldering tail projected behind the insulating housing. A top edge of the base plate extends forward to form an elastic arm fastened in the inserting slot. A free end of the elastic arm stretches into the receiving cavity and is further arched downward to form a contact portion electrically abutting against the first base board. An elastic element is received in the accommodating cavity and retractably located between the resisting board of the probe and the base plate of the terminal.

As described above, the probe is punched or curved from the metal board. So, the probe can be mass-produced by means of successively punching the metal boards apart arranged to a side edge of a material belt, with the resisting board being connected with the side edge of the material belt after processing the probe. Furthermore, the probe can be punched without a receiving hole shown in the prior art. Therefore, the probe can be electroplated continuously to realize a good electric conductivity and further improve production efficiency of the probe connector.

BRIEF DESCRIPTION OF THE DRAWINGS

The present invention will be apparent to those skilled in the art by reading the following description thereof, with reference to the attached drawings, in which.

DETAILED DESCRIPTION OF THE PREFERRED EMBODIMENT

Figure 2:
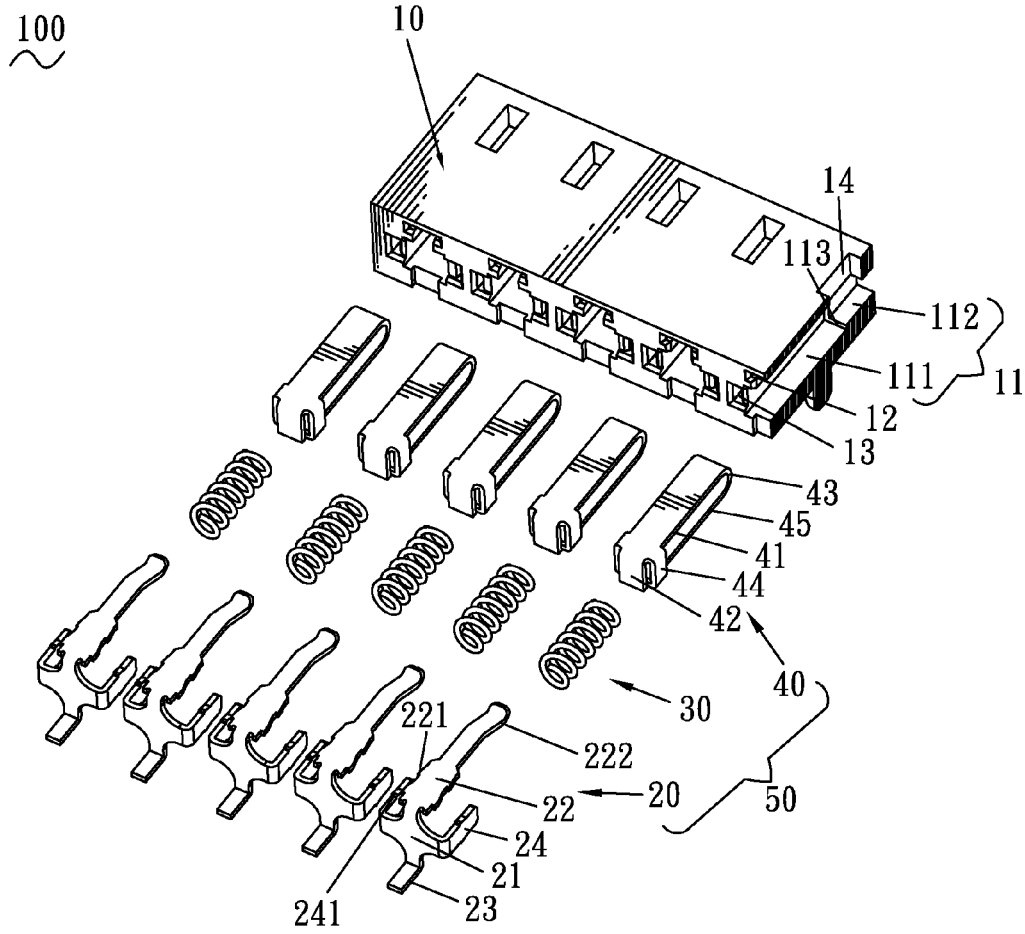
FIG. 2 is an exploded perspective view of the probe connector of FIG. 1, wherein an insulating housing is partly cut off.

With reference to FIG. 2, a probe connector 100 according to an embodiment of the present invention includes an insulating housing 10 and a plurality of probe pin assemblies 50 mounted in the insulating housing 10 respectively.

The insulating housing 10 is of a rectangular shape, and defines a plurality of inserting passages 11 arranged side by side along a transverse direction thereof and each extending longitudinally to penetrate through the insulating housing 10. The inserting passage 11 includes an accommodating cavity 111 penetrating through a rear side of the insulating housing 10, and a receiving cavity 112 penetrating through a front side of the insulating housing 10 and connected with a front of the accommodating cavity 111. A blocking rib 113 is protruded at the junction of the accommodating cavity 111 and the receiving cavity 112. A top side of the insulating housing 10 defines a plurality of receiving fillisters 14 arranged apart along the transverse direction thereof and each further extending downward to be connected with a top of one receiving cavity 112. A top wall of each accommodating cavity 111 is provided with an inserting slot 12 extending longitudinally to penetrate through the rear side of the insulating housing 10 and having a longitudinal middle thereof connected with a top of the accommodating cavity 111. The inserting slot 12 is further connected with the receiving cavity 112. Two opposite side walls of each accommodating cavity 111 are provided with a pair of fastening slots 13 each extending longitudinally to penetrate through the rear side of the insulating housing 10.

Referring to FIG. 2 again, the probe pin assembly 50 includes a terminal 20, a probe 40 and an elastic element 30. The terminal 20 and the probe 40 are made of metallic material. The terminal 20 has a base plate 21 of which a bottom edge is bent rearward to form a soldering tail 23 perpendicular to the base plate 21. Two opposite side edges of the base plate 21 extend forward to form a pair of fastening arms 24 spaced from and facing to each other. Top and bottom edges of each fastening arm 24 are designed with a plurality of fastening barbs 241 thereon. A middle of a top edge of the base plate 21 extends forward to form an elastic arm 22 of which two opposite side edges of one end connected with the base plate 21 protrude outward to form a plurality of fixing barbs 221, and a free end arching downward to form a contact portion 222.

The probe 40 is curved from a metal board and has a long rectangular first base board 41, a long rectangular second base board 45, and an arched contact head 43 connecting two end edges of the first base board 41 and the second base board 45 to make the first base board 41 and the second base board 45 apart face each other in parallel. The other end edge of the first base board 41 extends downward to form a resisting board 42 perpendicular to the first base board 41 and facing the contact head 43. The end of the first base board 41 adjacent to the resisting board 42 has two opposite side edges thereof extended downward and then face-to-face protruded to form a pair of blocking boards 44. In this embodiment, the elastic element 30 is a spring.

Figure 1:
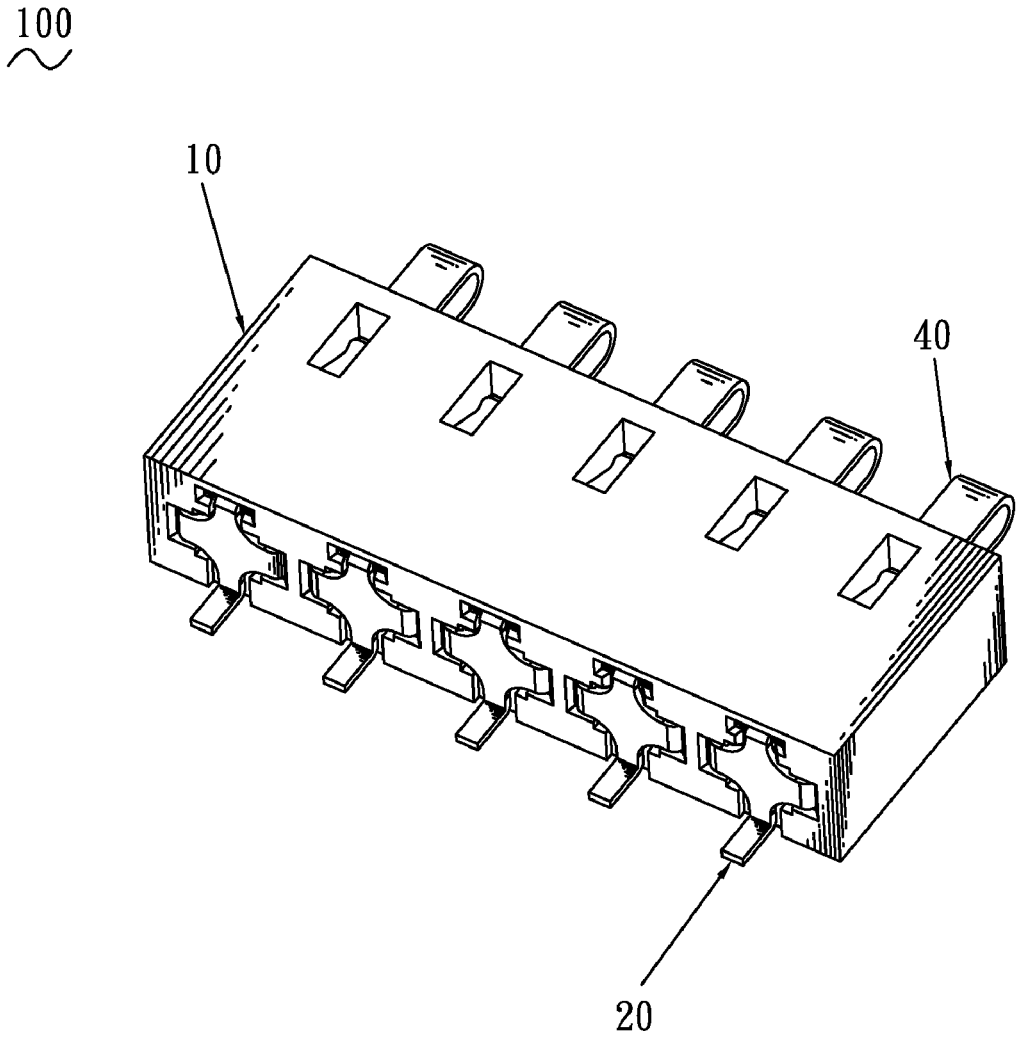
FIG. 1 is an assembled perspective view of a probe connector in accordance with an embodiment of the present invention.
Figure 3:
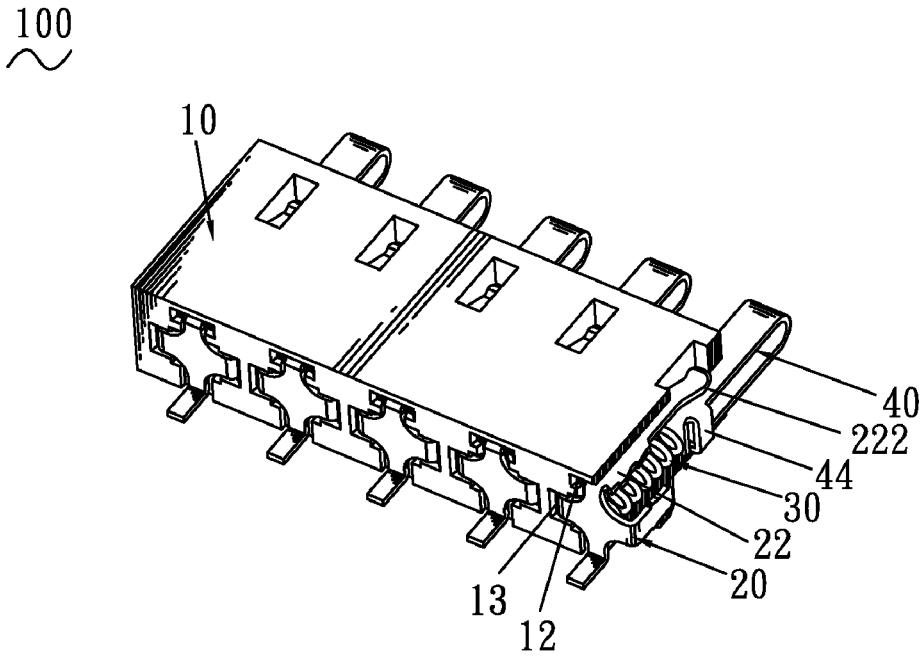
FIG. 3 is an assembled perspective view of the probe connector of FIG. 1 with the insulating housing being partly cut off to expose a probe pin assembly.

Referring to FIGS. 1-3, in assembly, the probes 40 are inserted forward into the inserting passages 11 of the insulating housing 10, with the end of the probe 40 together with the blocking boards 44 being disposed in the accommodating cavity 111, and the contact head 43 retractably stretching forward out of the receiving cavity 112, wherein the blocking boards 44 can be blocked by the blocking rib 113 to prevent the probe 40 from sliding out of the receiving cavity 112. The elastic element 30 is disposed in the accommodating cavity 111 of the insulating housing 10 with a front end thereof abutting against the resisting board 42 of the probe 40. Then, the terminal 20 is mounted to a rear of the insulating housing 10 to make the base plate 21 seal up a rear end of the accommodating cavity 111, by means of the fastening arms 20 being inserted in the fastening slots 13 with the fastening barbs 241 stabbed into insides of the corresponding fastening slot 13, and a rear of the elastic arm 22 being inserted in the inserting slot 12 with the fixing barbs 221 stabbed into insides of the inserting slot 12. A rear end of the elastic element 30 abuts against the base plate 21 of the terminal 20. The contact portion 222 stretches into the receiving fillister 14 and further elastically projects downward into the receiving cavity 112 to abut against the first base board 41 so as to realize an electrical connection of the terminal 20 and the probe 40.

In use, the contact head 43 of the probe 40 electrically connects with external mating contact (not shown) and is gradually pressed inward by the mating contact so as to further compress the elastic element 30 by virtue of the resisting board 42 of the probe 40. Accordingly, the elastic element 30 reflects an elasticity force back to the resisting board 42 of the probe 40 to make the contact head 43 of the probe 40 steadily connected with the mating contact.

As described above, the probe 40 of the probe connector 100 is punched or curved from the metal board. So, the probe 40 can be mass-produced by means of successively punching the metal boards apart arranged to a side edge of a material belt (not shown), with the resisting board 42 being connected with the side edge of the material belt after processing the probe 40. Furthermore, the probe 40 is punched without a receiving hole shown in the prior art. Therefore, the probe 40 can be electroplated continuously to realize a good electric conductivity and further improve the production efficiency of the probe connector 100.

The foregoing description of the present invention has been presented for the purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A probe connector, comprising:

an insulating housing defining a plurality of accommodating cavities each penetrating through a rear side of the insulating housing, and a plurality of receiving cavities each penetrating through a front side of the insulating housing and connected with a front of one accommodating cavity, a blocking rib being protruded at the junction of the accommodating cavity and the receiving cavity, a top wall of each accommodating cavity being provided with an inserting slot penetrating through the rear side of the insulating housing and further connected with the receiving cavity; and a plurality of probe pin assemblies including a probe curved from a metal board and having a first base board, a second base board and an arched contact head connecting two ends of the first base board and the second base board to make the first base board and the second base board apart face each other in parallel, the other end of the first base board being perpendicularly bent downward to form a resisting board, and further having two opposite side edges thereof extended downward and then face-to-face protruded to form a pair of blocking boards, the end of the probe with the blocking boards being disposed in the accommodating cavity, and the contact head retractably stretching forward out of the receiving cavity, wherein the blocking boards can be blocked by the blocking rib to prevent the probe from sliding out of the receiving cavity, a terminal having a base plate blocking a rear end of the accommodating cavity, a bottom edge of the base plate being bent rearward to form a soldering tail projected behind the insulating housing, a top edge of the base plate extending forward to form an elastic arm fastened in the inserting slot, a free end of the elastic arm stretching into the receiving cavity and being further arched downward to form a contact portion electrically abutting against the first base board, and an elastic element received in the accommodating cavity and retractably located between the resisting board of the probe and the base plate of the terminal.

2. The probe connector as claimed in claim 1, wherein a top side of each receiving cavity is concaved upward to form a receiving fillister for receiving the contact portion of the terminal.

3. The probe connector as claimed in claim 1, wherein two opposite side edges of a rear of the elastic arm protrude outward to form a plurality of fixing barbs stabbed in insides of the inserting slot.

4. The probe connector as claimed in claim 1, wherein two opposite side walls of each accommodating cavity are provided with a pair of fastening slots each extending longitudinally to penetrate through the rear side of the insulating housing, two opposite side edges of the base plate extend forward to form a pair of fastening arms inserted in the fastening slots respectively.

5. The probe connector as claimed in claim 4, wherein top and bottom edges of each fastening arm are designed with a plurality of fastening barbs stabbed in insides of the corresponding fastening slot.

* * * * *